United States Patent [19]

Noonan

[11] Patent Number: 4,954,976

[45] Date of Patent: Sep. 4, 1990

[54] METHOD FOR SIMULATING DYED FABRIC

[75] Inventor: Kevin K. Noonan, Kortrijk, Belgium

[73] Assignee: Sophis Systems N.V., Kortrijk, Belgium

[21] Appl. No.: 229,469

[22] Filed: Aug. 8, 1988

[30] Foreign Application Priority Data

Aug. 6, 1987 [NL] Netherlands ..... 8701858

[51] Int. Cl.[5] ..... G06F 15/70

[52] U.S. Cl. ..... 364/578; 364/526; 358/75

[58] Field of Search ..... 364/521, 526, 578; 356/402, 409, 410; 358/75, 80; 8/400

[56] References Cited

U.S. PATENT DOCUMENTS

| | | | |
|---|---|---|---|
| 4,078,253 | 3/1978 | Kajiura et al. | 364/900 |
| 4,597,670 | 7/1986 | Ohashi et al. | 364/526 |
| 4,613,947 | 9/1986 | Suzuka et al. | 364/526 |
| 4,688,178 | 8/1987 | Connelly et al. | 364/526 |
| 4,788,650 | 11/1988 | Willis et al. | 364/526 |
| 4,819,193 | 4/1989 | Imao | 358/75 |

FOREIGN PATENT DOCUMENTS 14211911 1/1976 United Kingdom .

*Primary Examiner*—Gary Chin
*Assistant Examiner*—Christopher L. Makay
*Attorney, Agent, or Firm*—Young & Thompson

[57] ABSTRACT

Method for simulating a dyed fabric, in which an image of the dyed fabric is produced on a display device, such as a color monitor, or on a hardcopy. The fabric to be simulated consists of dyed yarns woven into each other which each consist of interrupted pieces of particular shape at the surface perceptible to the eye. The colors of all the points in the total surface of each simulated shape are summed and corrected so that the average color is approximately the same as the spectrophotometrically measured color of the shape of the fabric in reality, The simulated shape is embodied in a manner such that it is approximately the same as the shape of the yarn which the eye will observe when observing the fabric in reality and which is provided with shading at the edges when it passes over and beneath other yarns. For the purpose of defining the position of the surface of the simulated shape in the three-dimensional space, the shape is chosen as an elliptical shape between two yarns passing thereover.

6 Claims, 2 Drawing Sheets

METHOD FOR SIMULATING DYED FABRIC

The invention relates to a method for simulating a dyed fabric, an image of the dyed fabric being produced on a display device, such as a colour monitor or on a hardcopy, the fabric to be simulated consisting of dyed yarns woven into each other which each consist of interrupted pieces of particular shape at the surface perceptible to the eye. Such a method is known in practice.

In the following the words 'yarn shape' or 'shape' refer to the piece of yarn visible on the surface of the fabric as it loops from one locking point to another. This shape will be only the visible part of the yarn and it must be noted that on a loosely woven fabric, there may be visible underlying yarns or the background colour on which the fabric is lying on. The shape would typically not be rectangular but it may appear so, if the yarn surfaces are made to simulate a cloth which would be finished in a calender.

In the past manufacturers of fabrics have, as a rule, made samples of actual fabric which give an impression of the different designs and colours to enable the customer to make a choice. This is an exceptionally time-consuming and costly process. This is because the weaver must have all the dyed yarns available and have the looms set up in order to make samples in all colour combinations. If the initial sorting and selection of the various design ideas could be carried out by means of a simulated fabric, the number of yarns that would have to be dyed and the number of looms which could be necessary for making the samples could be appreciably reduced.

At present on the order of 20% or less of all woven samples which are shown to the customers are actually put into production. If the quantity of woven samples could be reduced, fewer yarns would have to be dyed separately for the samples and the sample looms could be made available for production.

It is known in industry for an image of the fabric or cloth to be made in the same size as the final woven cloth on a colour monitor or on a hardcopy such as an image on paper, photo, transparency, colour slide, etc. In the case of finer fabrics the initial image is then enlarged, while, on the other hand, in the case of heavier and rougher fabrics, the initial image is often reduced.

To simulate the said fabric, use is therefore made of blocks of uniform colour for every shape, visible to the eye, of the yarns at the surface of the fabric. In general the colour for the block is chosen by making a visual choice from a prepared set of colours.

In an improvement to this method it is possible to provide darker points at the side edges of the colour blocks in order to portray a certain definition of the shape of the yarn. Some general patterns of a random nature may also be added over the surface in order to simulate different finishing effects. A spectrophotometer has also been used in order to measure the colour of the yarns and the prepared colour blocks. This was then used as an aid for matching the yarns to the colour block.

One problem in the above method is that, because they do not adequately reproduce the true structure, the images are not realistic and that in general the colours on the colour monitor or the hardcopy are insufficiently precise compared with the actual fabric or cloth.

The object of the invention is to eliminate the above-mentioned problems.

This is achieved in a method of the type mentioned in the preamble in that the colours of all the points in the total surface of each simulated shape are summed and corrected so that the average colour is approximately the same as the spectrophotometrically measured colour of the shape of the fabric in reality.

In a further embodiment of the method according to the invention, the simulated shape is embodied in a manner such that it is approximately the same as the shape of the yarn which the eye will observe when observing the fabric in reality and which is provided with shading at the edges when it passed over and beneath other yarns.

The invention will be explained below in more detail by reference to an embodiment of the method for simulating a fabric with a realistic appearance by means of a more accurate colour adjustment. This simulation is based on the actual colours and construction details of a fabric which may or may not have been woven previously. Said method will be explained below by reference to various steps, and in connection with the accompanying schematic drawings, in which.

Figure 1:
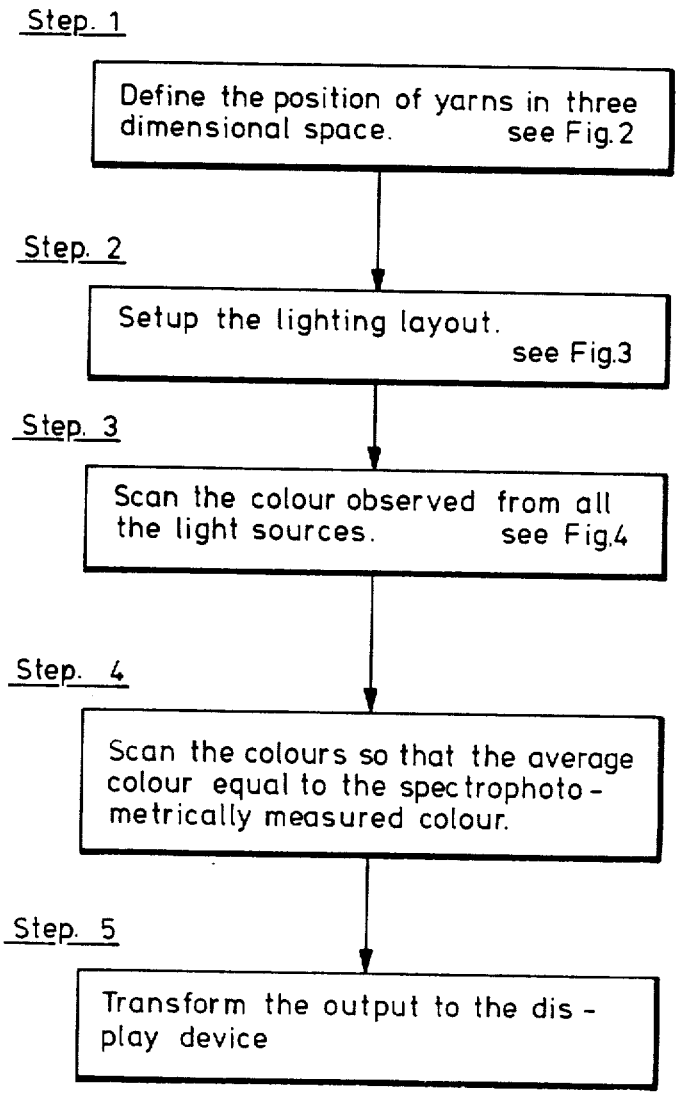
FIG. 1 is a flow chart showing the overall method according to this embodiment.
Figure 2:
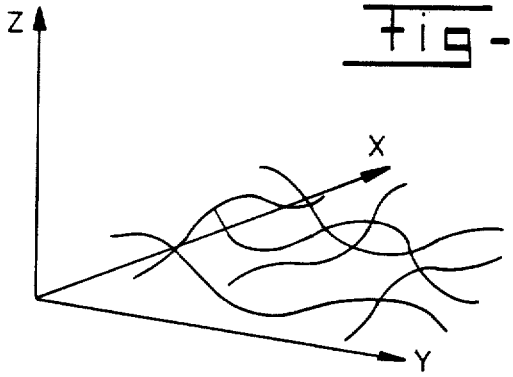
FIG. 2 is a diagram illustrating the step of defining the yarn position.
Figure 3:
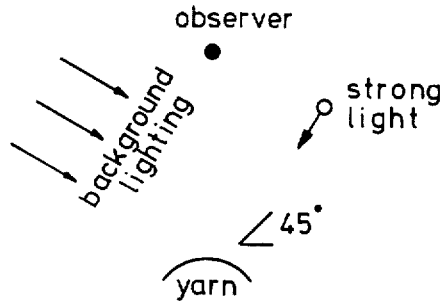
FIG. 3 illustrates the step of simulating an illumination condition for the fabric model.
Figure 4:
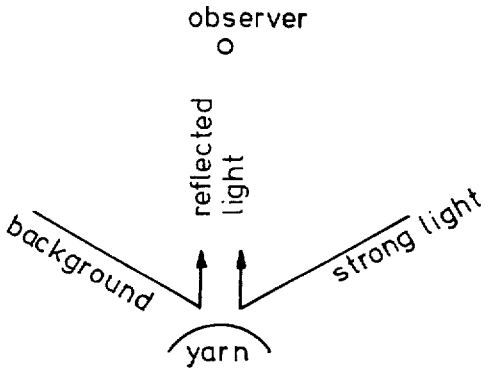
FIG. 4 illustrates the step of forming a visual representation of the colors visible in the points at the surface of the yarn shape.

In the first step a definition of the position of the surface of the yarn shapes is given in three dimensional space. This can be carried out with various levels of refinement. These start from a simple predictive method based on the density of the yarns in the woven cloth, such as is put forward in the book entitled "Structural Mechanics of Fibers, Yarns and Fabrics" by Hearle, Grosberg and Backer, and proceed to a complete and elaborate analysis based on the solution of differential equations of the strength and stretch of the yarn and the physical forces involved in weaving. Since fabric simulation mostly relates to simple fabrics, a relatively simple technique will be described here.

In this connection it is assumed that the yarns in essence always has an elliptical shape between the various crossing points and under these circumstances follow a loop described as a cartesian function between the two transverse yarns which cross over. At the same time the distance between the yarns is chosen to be equal to that which would exist in the final woven cloth, small variations in position being allowed in order to simulate the natural variation in weaving.

Advantageously, the simulated yarn shapes are represented as being three dimensional and realistically reproduce the image of slipping under the other yarns and rising above them. At the same time, the natural variations in weaving can be simulated and the shapes and positioning of the yarns can be simulated as a function of the forces exerted in the loom.

In a second step an illumination has to be simulated on the basis of a general background illumination and a strong directional illumination at an angle of for example 45° to the surface of the woven cloth. If the ratio of the background illumination to directional illumination is one to four, this provides a reasonable approximation of seeing a woven cloth near a window with normal daylight. This illumination model can be adapted to various applications but, in general, preference is given to illumination with a strong degree of directivity in a particular direction.

In the third step a visual representation is made of the colours visible in the points at the surface of the yarn shape. In this connection use is advantageously made of "ray-tracing" known in the art. This is described, inter alia, in the book entitled "Computer Graphics" by Steven Harrington.

In addition, surface modelling can be introduced in this connection by providing various reflectances and texture at the yarn surface in order to simulate the various yarns. At the same time, a random variation can also be introduced by changing the actual angle which the plane of the yarn surface will make with the incident light.

In the fourth step, the very important colour matching is carried out according to the invention. In this the colours of the simulated shape are corrected in a manner such that the average colour thereof is identical to the spectrophotomerically measured colour of the actual yarn shape. The human eye sees a different colour if the material is illuminated with different light. Hence it is generally not possible to colour match any one simulation under all lighting conditions. To resolve this problem only one lighting condition is considered at a time, and the colour match becomes equating the X, Y and Z co-ordinates of the simulates shape to the X, Y and Z co-ordinates of the actual coloured yarn. The X, Y and Z co-ordinates of the yarn are calculated from the reflectances measured by the spectrophotometer, the spectra of the incident light and the response of the eye.

Said colour matching is in principle possible under various standard illumination conditions. Preferably, use is made of the same illumination conditions, such as the D6500 Standard Lighting, for measuring the spectral reflectances from the yarns and from the hardcopy. As a result of this, the calculations can be simplified to using X, Y and Z co-ordinates of each colour point instead of starting from sixteen or thirty-one spectral points. This calculation for matching the colour proceeds as follows:

(a) conversion of each point (X, Y, Z) in the threedimensional space at the surface of the (elliptical) loop shape into a hue, saturation and lightness standard model;

(b) summing said hue, saturation and lightness values of each point over the surface of the shape;

(c) comparison of said summed values with the hue, saturation and lightness values of the yarn shape actually measured spectrophotometrically; and (d) distribution of the error difference found over the total number of points in the loop shape.

This ensures that the total visual effect of the yarn shape is the same as that of the actual yarn shape even if some parts may have a pure white spectral value and some other points a virtually black coloration as a result of shading effects. The changes in the reflected colours follow the same changes which would occur in the actual fabric.

The fifth step depends on the type of hardcopy machine used. Here the total range of the colours produced in the third and fourth steps is reduced to the number of colours which can be processed by the monitor or hardcopy machine. If the machine is a photographic machine, virtually no further processing is necessary in practice apart from a few corrections for the gamma of the film plus an overlapping or underlapping of the pixels. If a colour printer is used which has only a limited number of colours possible in any pixel, for example a thermo-transfer printer or a fixed drop inkjet printer, the total range of the simulated colours will have to be converted into the limited range of colours available to the printer. In doing this, the procedure is as follows.

(e) The colours determined by the third and fourth steps are set out in a matrix with the same pitch as the finest pitch of the printer;

(f) The process moves over the array and at every pixel in the array;

(i) the basic colour of the printer is chosen which is the closest fit;

(ii) the error between the chosen printing colour and the desired colour is calculated;

(iii) the error is split into three parts. These error parts are added respectively to the next pixel in the row, to the pixel directly above in the next row, and to the pixel diagonally above in the next row.

The ratio of the partitioning is arbitrary and is based on experience but is characteristically 0.3, 0.4 and 0.3 respectively.

This technique retains the original colours of the simulation process but is only effective if the number of pixels for each elliptical loop shape of the yarn is reasonably large (for example, ten or more). A further improvement is possible by limiting the error correction to within each loop of a yarn. This is done by changing the error splitting algorithm for the border of the yarn shape so as to add all the error to the next pixel in the row, and by calculating for the effects of some overlapping or underlapping of the data produced on the printer.

Currently the most suitable hardcopy machines are inkjet or thermo-transfer printers. Matrix printers which have inked ribbons are in general not suitable as a result of the variation in the impression of the striking mechanism, and the multiple use of an inked ribbon makes prediction of the colour difficult.

Plotters have only a limited value with regard to this technique since they are not mechanically designed to reproduce dots in an efficient manner.

It is obvious that the method of the invention described above is also suitable for simulating knitted or crocheted fabrics. In this case, the simulated shape of each yarn will approximate the loops made in knitting.

Furthermore, the method according to the invention can be carried out not only for yarns dyed beforehand but also for undyed cloths which are subsequently printed with colours.

The method can also be used for carpets and velours, in which each simulated shape will have to approximate a tuft.

I claim:

1. Method for simulating a dyed fabric having dyed yarns woven into each other and each comprising interrupted pieces of particular yarn shape at a surface perceptible to the eye, comprising simulating a position and an illumination condition for said yarn shapes, forming a visual representation of colors visible at points on the surface of said yarn shapes, spectrophotometrically measuring a color of an actual yarn shape to be simulated, summing and correcting values representative of colors in said visual representation such that each simulated yarn shape has an average color approximately the same as the spectrophotometrically measured color of the actual yarn shape, and displaying an image of the simulated dye fabric on a display device.

2. The method according to claim 1, further comprising simulating said yarn shapes such that they have a surface contour approximately the same as said actual yarn shape.

3. The method according to claim 2, wherein said simulated yarn shapes are elliptical.

4. The method according to claim 1, wherein the step of defining the position and illumination of said yarn shapes comprises defining a first background illumination and a second directional illumination having an angle of about 45° with respect to the simulated surface of the fabric, and wherein said step of forming a visual representation comprises a ray-tracing technique.

5. The method according to claim 2, wherein values representative of surface reflectance are used to simulate a desired surface contour on said yarn shapes.

6. The method according to claim 3, wherein said step of forming a visual representation comprises assigning to each point in the three-dimensional space of the yarn shape values corresponding to hue, saturation and lightness value at the simulated surface, and said summing and correcting step comprises comparing said hue, saturation and lightness values of all the points on the yarn shape with the spectrophotometrically measured hue, saturation and lightness values of the actual yarn shape, and distributing an error difference over the total number of points in each simulated yarn shape.

* * * * *